United States Patent [19]

McKechnie

[11] 4,307,316

[45] Dec. 22, 1981

[54] SELF CLEANING SPARK PLUG

[76] Inventor: Ian C. McKechnie, 252-27 E. Tropicana, Las Vegas, Nev. 89109

[21] Appl. No.: 807,437

[22] Filed: Jun. 17, 1977

Related U.S. Application Data

[63] Continuation-in-part of Ser. No. 654,299, Feb. 2, 1976.

[51] Int. Cl.[3] ..... H01T 13/20

[52] U.S. Cl. ..... 313/143; 313/135

[58] Field of Search ..... 313/143, 135, 139

[56] References Cited

U.S. PATENT DOCUMENTS

| | | | |
|---|---|---|---|
| 2,122,242 | 6/1938 | Bidwell | 313/143 X |
| 2,251,179 | 7/1941 | Weinerth | 313/143 X |
| 2,356,053 | 8/1944 | Hastings et al. | 313/138 X |
| 2,934,668 | 4/1960 | Dall | 313/135 |
| 3,317,774 | 5/1967 | Hamilton | 313/143 |
| 3,800,179 | 3/1974 | Louzecky | 313/143 X |
| 4,028,576 | 6/1977 | Woffey | 313/143 |
| 4,082,976 | 4/1978 | Lentz | 313/135 |

*Primary Examiner*—Palmer C. Demeo
*Assistant Examiner*—Darwin R. Hostetter

[57] ABSTRACT

An economically manufacturable self cleaning spark plug which utilizes combustion gas flow effectively to keep the tip of the plug clean and retains gap spacing indefinitely thereby assuring long spark plug life.

4 Claims, 4 Drawing Figures

SELF CLEANING SPARK PLUG

This application is a continuation in part of U.S. patent application Ser. No. 654,299 filed Feb. 2, 1976 and entitled *MULTIPLE SPARK IGNITION SYSTEM.*

BACKGROUND OF THE INVENTION

This invention relates to spark plugs for internal combustion engines, and more particularly to an economically manufacturable self cleaning spark plug wherein one of the two electrodes of the spark plug is the shell of the spark plug and the other of the electrodes is the known axially positioned center electrode together forming an air gap, the spacing of which may be retained indefinitely.

DESCRIPTION OF THE PRIOR ART

Spark plug gaps in the prior art take many different forms including the conventional automotive spark plugs utilizing a plug gap between an electrode welded to the lower end of the shell of the spark plug with its free end projecting toward an axially aligned center electrode. Further, aircraft spark plugs are known wherein four side electrodes are similarly attached all having their free ends projecting toward an axially aligned center electrode with each side electrode and the center electrode providing an air gap across which the current from an ignition system discharges to form the spark for combustion purposes.

Spark plugs for use in marine engines sometimes employ an annular spark gap formed by the outer shell of the spark plug which is cupped inwardly over the insulator surface of the spark plug toward the center electrode which is positioned axially of the spark plug, called a surface gap.

Additionally, many aircraft and military vehicle spark plugs enclose the entire exterior of the insulator of the spark plug in a metal shell and employ a metal nut and grommet seal to obtain both a watertight joint as well as eliminating radiation that might affect radio communication.

SUMMARY OF THE INVENTION

In accordance with the invention claimed, an improved spark plug is disclosed which retains gap spacing indefinitely providing long spark plug life.

It is, therefore, one object of this invention to provide an improved spark plug for internal combustion engines.

Another object of this invention is to provide an improved spark plug in which combustion gas flow aids in keeping the tip of the insulator surrounding the axially positioned electrode free of foreign matter.

A further object of this invention is to provide an improved spark plug utilizing the outside shell of the spark plug as one of the electrodes.

A still further object of this invention is to provide an improved spark plug providing a large area for sparking purposes such that any erosion of the electrode surfaces does not materially increase the gap length between the electrodes.

A still further object of this invention is to provide an improved spark plug having a junction of the spark plug cable with the external portion of the spark plug insulator rendered watertight.

These and other objects and advantages of the present invention will become apparent as the following description proceeds and the features of novelty which characterize this invention will be pointed out with particularity in the claims annexed to and forming a part of this specification.

BRIEF DESCRIPTION OF THE DRAWING

The present invention may be more readily described by reference to the accompanying drawing, in which.

DESCRIPTION OF THE PREFERRED EMBODIMENT

Figure 1:
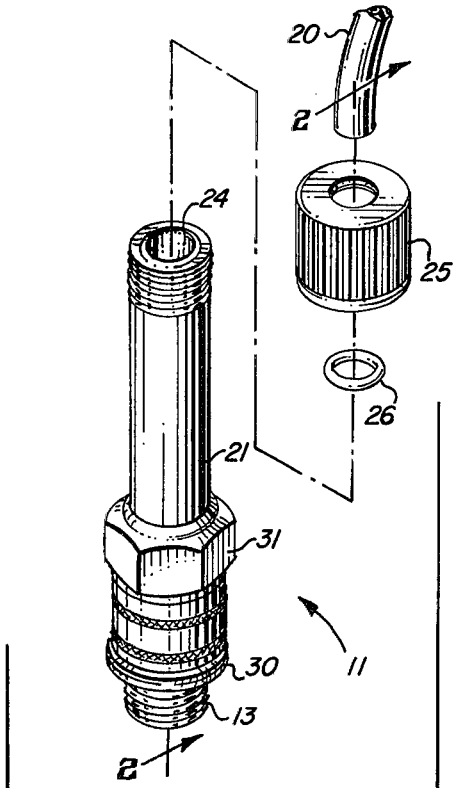
FIG. 1 is an exploded view of a spark plug and its co-related spark plug cable embodying the invention.
Figure 2:
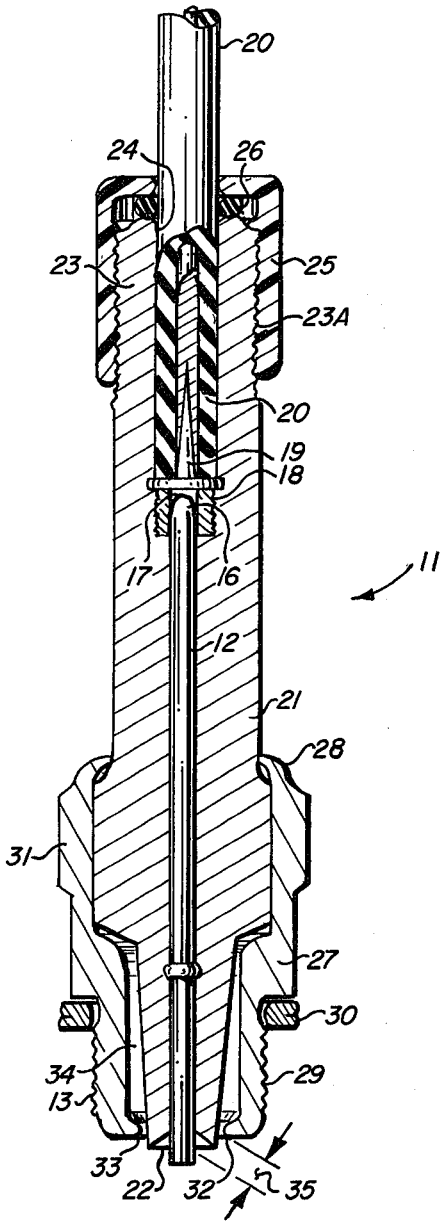
FIG. 2 is a sectional view through the assembled spark plug in FIG. 1 and showing the improved gap arrangement.
Figure 3:
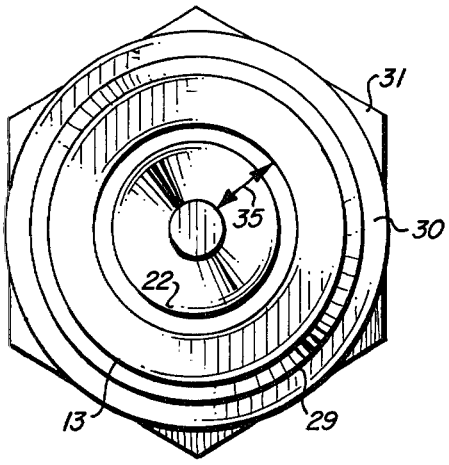
FIG. 3 is a bottom view of FIG. 2.

Referring more particularly to the drawing by characters of reference, FIGS. 1 and 2 disclose a spark plug 11 through the center of which extends an electrode 12. A threaded end 13 of the spark plug 11 is adapted for positioning within an opening in the cylinder head of an internal combustion engine (not shown).

A first end 16 of electrode 12 is adapted to snugly fit into a tubular socket 17 formed in an exteriorly threaded member 18. The threaded member 18 is formed axially and integrally with a needle pointed member 19 over which an associated spark plug cable 20 is forced, thereby making electrical contact with the center electrode 12.

Surrounding the center electrode 12 is positioned an elongated ceramic insulator 21, one end 22 having the associated end of the juxtapositioned center electrode 12 projecting slightly therebeyond.

The other end 23 of the ceramic insulator 21 is provided with an opening 24 extending axially thereof over and axially beyond the needle pointed member 19 for providing a socket for receiving the end of spark plug cable 20 which is forced over the needle pointed member 19.

The external surface of end 23 of the ceramic insulator 21 is threaded or otherwise formed at 23A for mating with a cap 25 which compresses an O-ring or grommet 26 thus providing a water or moisture seal between the spark plug insulator 21 and the associated spark plug cable 20.

Surrounding the ceramic insulator 21 at the cylinder or engine end thereof is juxtapositioned a tubular metallic shell 27 which is crimped at its end 28 thereof for snugly fitting around the ceramic insulator and its other end 29 is threaded for threadably fitting into the cylinder head of an internal combustion engine and sealed thereto by a gasket 30. It should be noted that end 28 of shell 27 is formed to provide a surface 31 for accepting a wrench to threadably connect the spark plug 11 to the cylinder head of the engine.

At the tip 32 of the threaded end 29 of shell 27 the metal thereof is formed to provide a circular opening or orifice opening 33 into a cavity 34 formed between the internal periphery of the shell and the juxtapositioned surface of ceramic insulator 21, as more clearly shown in FIG. 2.

Thus, on each combustion stroke of the internal combustion engine, hot combustion gases are forced at high velocity in and out of cavity 34 past the tip 22 of the ceramic insulator 21 thereby keeping the tip of the ceramic insulator fee of deposits that cause spark plug fouling.

The annular gap 35 formed between the end of center electrode 12 and the inwardly formed end 32 of shell 27 provides a large area for sparking between it and the center electrode, thus reducing changes in spark gap length with erosion.

In practice, spark plugs so designed, after thousands of miles of engine use, have still been satisfactory even though the end of the center electrode 12 has eroded away so that it is flush with the tip 22 of the ceramic insulator 21.

Figure 4:
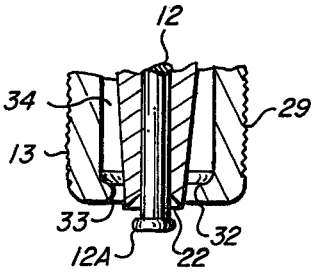
FIG. 4 is a partial sectional view of a modification of the combustion end of the spark plug.

FIG. 4 discloses a modification of the spark end of the center electrode 12 wherein the end 12A is upset or enlarged to reduce the gap length.

While it will be apparent that the preferred embodiment of the invention disclosed is calculated to fulfill the objects above stated, it will be appreciated that the invention is susceptible to modification, variation and change without departing from the scope or fair meaning of the invention.

What is claimed is:

1. A spark plug comprising:

a cylindrical ceramic insulator, an electrode axially positioned within said insulator and having a first end extending beyond a first end of said insulator, a hollow cylindrical shell surrounding a portion of said insulator, one end portion of said shell being sealed to said insulator at a predetermined distance from said first end of said insulator, said shell extending beyond said sealed portion toward said first end of said insulator and having a threaded portion on at least a part of its outer periphery for engaging with the cylinder head of an associated engine, said shell having an internal diameter larger than the corresponding coaxial part of said insulator and forming a cavity therebetween, and the end of said shell adjacent said threaded portion creating an annular orifice between the said first end of said insulator and the inner diameter of said shell with said end of said shell forming a second electrode of the plug, said first end of said insulator extending beyond the inwardly formed end of said shell, the other end of said insulator extending beyond said one end portion of said shell and the other end of said electrode and defining a cylindrical opening axially aligned with said electrode for receiving therein an associated spark plug cable, the other end of said electrode comprising a needle point projecting into said cylindrical opening for engaging with the spark plug cable.

2. The spark plug set forth in claim 1 wherein:

the outer periphery of said other end of said insulator is threaded or otherwise formed for receiving cap means, and cap means for engaging the end of said insulator for sealing engagement with a spark plug cable when inserted into said opening.

3. A spark plug comprising:

a cylindrical ceramic insulator, an electrode axially positioned within said insulator and having a first end extending beyond a first end of said insulator, a hollow cylindrical shell surrounding a portion of said insulator, one end portion of said shell being sealed to said insulator at a predetermined distance from said first end of said insulator, said shell extending beyond said sealed portion toward said first end of said insulator and having a threaded portion on at least a part of its outer periphery for engaging with the cylinder head of an associated engine, said shell having an internal diameter larger than the corresponding coaxial part of said insulator and forming a cavity therebetween, and the end of said shell adjacent said threaded portion being formed inwardly to create an annular orifice between the said first end of said insulator and the inner diameter of said shell with said end of said shell forming a second electrode of the plug, said first end of said insulator extending beyond the inwardly formed end of said shell.

4. The spark plug set forth in claim 3 wherein:

said one end of said electrode is enlarged to form a head.

* * * * *

Disclaimer 4,307,316.—*Ian C. McKechnie,* Las Vegas, Nev. SELF CLEANING SPARK PLUG. Patent dated Dec. 22, 1981. Disclaimer filed Apr. 19, 1982, by the inventor.

Hereby enters this disclaimer to claims 3 and 4 of said patent.

[*Official Gazette June 29, 1982.*]